US006146474A

United States Patent [19]

Coutu et al.

[11] Patent Number: 6,146,474

[45] Date of Patent: Nov. 14, 2000

[54] IRON-COBALT ALLOY

[75] Inventors: Lucien Coutu; Laurent Chaput, both of Sauvigny-les-Bois, France

[73] Assignee: Imphy Ugine Precision, Puteaux, France

[21] Appl. No.: 09/231,765

[22] Filed: Jan. 15, 1999

[30] Foreign Application Priority Data

Feb. 5, 1998 [FR] France ..... 98 01310

[51] Int. Cl.[7] ..... H01F 1/14

[52] U.S. Cl. ..... 148/315; 148/313; 148/311; 420/435; 420/581

[58] Field of Search ..... 148/311, 313, 148/315; 420/435, 121, 127, 581

[56] References Cited

U.S. PATENT DOCUMENTS

| | | | |
|---|---|---|---|
| 2,519,277 | 8/1950 | Nesbitt et al. | 148/315 |
| 3,065,118 | 11/1962 | Wawrousek et al. | 148/311 |
| 3,634,072 | 1/1972 | Ackerman et al. . | |
| 3,891,475 | 6/1975 | Tomita et al. . | |
| 4,933,026 | 6/1990 | Rawlings et al. | 148/311 |
| 5,501,747 | 3/1996 | Masteller et al. . | |

FOREIGN PATENT DOCUMENTS

| | | |
|---|---|---|
| 2 423 550 | 11/1979 | France . |
| 1 523 881 | 9/1978 | United Kingdom . |
| 2 207 927 | 2/1989 | United Kingdom . |

OTHER PUBLICATIONS

Patent Abstracts of Japan, Publication No. 01255645, Dec. 1989.

*Primary Examiner*—John P. Sheehan

*Attorney, Agent, or Firm*—Oblon, Spivak, McClelland, Maier & Neustadt, P.C.

[57] ABSTRACT

An iron—cobalt alloy the chemical composition of which comprises, by weight: $35\% \leqq Co \leqq 55\%$; $0.5\% \leqq V \leqq 2.5\%$; $0.02\% \leqq Ta+2\times Nb \leqq 0.2\%$; $0.0007\% \leqq B \leqq 0.007\%$; $C \leqq 0.05\%$; the balance being iron and impurities resulting from the smelting operation.

23 Claims, No Drawings

IRON-COBALT ALLOY

FIELD OF THE INVENTION

The present invention relates to an iron—cobalt alloy having improved mechanical properties.

Iron-cobalt alloys are well known and characterized both by very useful magnetic properties and by a very high degree of brittleness at ordinary temperatures, which makes them difficult to use. In particular, the alloy Fe50Co50, containing 50% cobalt and 50% by weight, has a very high saturation induction and good magnetic permeability, but it has the drawback of not being able to be cold rolled, making it practically unusable. This very high degree of brittleness results from the formation, below approximately 730° C., of an ordered α' phase resulting from a disorder-order transformation. This disorder-order transformation may be slowed down by the addition of vanadium, thereby making it possible to manufacture an alloy of the iron—cobalt type, containing about 50% cobalt and about 50% iron, which can be cold rolled after a very vigorous hyperquench. Thus, an alloy containing approximately 49% cobalt and 2% vanadium, the balance being iron and impurities, has been proposed. This alloy, which does have very good magnetic properties after cold rolling and annealing between 720° C. and 870° C. approximately, has, however, the drawback of requiring special precautions to be taken during the reheat which precedes the hyperquench, so as to limit the grain coarsening which is to the detriment of ductility.

PRIOR ART

In order to facilitate the reheat before hyperquenching, it has been proposed, especially in U.S. Pat. No. 3,634,072, to add from 0.02% to 0.5% of niobium and optionally from 0.07% to 0.3% of zirconium so as to limit the risk of grain coarsening during the reheat. The magnetic properties and the ductility of the alloy thus obtained are comparable, but not superior, to those of the alloy containing only 2% vanadium. The reheat before hyperquenching is simply easier to carry out.

Moreover, it has been observed that vanadium could be replaced by niobium or tantalum. Thus, U.S. Pat. No. 4,933,026 has proposed an alloy containing at least one element taken from niobium and tantalum in amounts such that their sum is between 0.15% and 0.5% (by weight). This alloy, which has a comparable ductility to the previous alloy, has the advantage of being able to be annealed at a higher temperature, thereby allowing superior magnetic properties to be obtained. However, it has the drawback of having a relatively low electrical resistivity. This increases the induced-current losses and limits the possible ways of using it.

Finally, all these alloys have tensile strength mechanical properties which are insufficient for some applications, such as for the magnetic circuits of machines rotating at very high rotation speeds. This is because it is hardly possible to obtain a yield stress greater than 480 MPa.

In order to improve these mechanical properties, an alloy has been proposed, especially in International Patent Application WO 96/36059, which essentially contains (by weight) 48% to 50% cobalt, 1.8% to 2.2% vanadium, 0.15% to 0.5% niobium and 0.003% to 0.02% carbon, the balance being iron and impurities. In this patent application it is specified that the niobium may be completely or partially replaced by tantalum in an amount of 1 atom of tantalum per 1 atom of niobium. Given the respective atomic weights of tantalum and niobium, this corresponds to more than 2% tantalum by weight per 1% niobium by weight. In this alloy, niobium (or tantalum) forms, along the grain boundaries, Laves phases which prevent grain coarsening, thereby significantly increasing the yield stress, but without significantly improving the ductility. By way of example, after annealing at 720° C., the yield stress may exceed 600 MPa. However, these mechanical properties can only be obtained with relatively large additions of niobium or tantalum.

The relatively large additions of niobium or tantalum are needed in order to obtain a high yield stress while still annealing at the top of the recrystallization temperature range, which has the advantage of leading to a low sensitivity of the result obtained at the effective annealing temperature. On the other hand, this approach has the drawback of reducing the hot rollability of the alloy.

SUMMARY OF THE INVENTION

The object of the present invention is to provide an iron—cobalt alloy having, at the same time, satisfactory ductility, good magnetic properties and improved mechanical properties, while still having good hot rollability.

For this purpose, the subject of the invention is an iron—cobalt alloy with a chemical composition which comprises, by weight:

- from 35% to 55%, and preferably from 40% to 50%, cobalt,
- from 0.5% to 2.5%, and preferably from 1.5% to 2.2%, vanadium,
- at least one element taken from tantalum and niobium, in contents such that $0.02\% \leqq Ta+2\times Nb \leqq 0.2\%$, and preferably such that $0.03\% \leqq Ta+Nb \leqq 0.15\%$, and better still such that $Nb \leqq 0.03\%$,
- from 0.0007% to 0.007%, and preferably from 0.001% to 0.003%, boron,
- less than 0.05%, and preferably less than 0.007%, carbon, the balance being iron and impurities resulting from the smelting operation. Preferably, the impurities, which are manganese, silicon, chromium, molybdenum, copper, nickel and sulfur, have contents such that:

$$Mn+Si \leqq 0.2\%,\ Cr+Mo+Cu \leqq 0.2\%,\ Ni \leqq 0.2\% \text{ and } S \leqq 0.005\%.$$

The inventors have surprisingly observed that, when from 0.0007% to 0.007%, or better still from 0.001% to 0.003%, boron by weight is added to an iron—cobalt alloy containing, moreover, from 0.5% to 2.5%, or better still from 1.5% to 2.2%, vanadium as well as a small quantity of elements such as tantalum and niobium, the yield stress of the alloy was very significantly increased, while still maintaining satisfactory magnetic properties and still having very good hot rollability.

DESCRIPTION OF THE PREFERRED EMBODIMENTS

By way of example and of comparison, alloys A and B according to the invention and alloy C according to the prior art were produced. From these alloys were manufactured, by hot rolling in the region of 1200° C., 2 mm thick sheets which were hyperquenched by cooling from 800° C. to 100° C. in less than 1 second. The strips thus obtained were cold rolled in order to obtain 0.35 mm thick strips. These cold-rolled strips were then annealed, according to the prior art, at temperatures ranging between 700° C. and 900° C. so as to give them the properties for their use. The mechanical and magnetic properties obtained were then measured. Alloys A and B were hot rolled without any difficulty, that is to say without the appearance of corner cracks.

The chemical compositions were as follows (the balance being iron):

| | Co | V | Ta | Nb | B | C | Mn | Si | Cr | Ni | Cu | S | P |
|---|---|---|---|---|---|---|---|---|---|---|---|---|---|
| A | 48.5 | 1.98 | — | 0.044 | 0.0022 | 0.011 | 0.102 | 0.06 | 0.04 | 0.11 | 0.01 | 0.004 | 0.005 |
| B | 48.1 | 1.9 | 0.17 | — | 0.0012 | 0.005 | 0.05 | 0.06 | 0.02 | 0.2 | 0.01 | 0.002 | 0.005 |
| C | 48.7 | 1.97 | — | 0.064 | — | 0.010 | 0.09 | 0.05 | 0.04 | 0.12 | 0.01 | 0.003 | 0.005 |

The mechanical properties obtained after annealing at 725° C., 760° C. and 850° C. were ($R_{e0.2}$=yield stress; HV=Vickers hardness):

| | $R_{e0.2}$ (MPa) | | | HV | | |
|---|---|---|---|---|---|---|
| | 725° C. | 760° C. | 850° C. | 725° C. | 760° C. | 850° C. |
| A | 530 | 470 | 390 | 260 | 250 | 230 |
| B | 675 | 475 | 330 | 315 | 263 | 222 |
| C | 480 | 420 | 310 | 250 | 240 | 220 |

The magnetic properties measured were:

the values of the magnetic induction B (in tesla) for DC magnetic excitations H of 20 Oe=1600 A/m, 50 Oe=4000 A/m and 100 Oe=8000 A/m;

the coercive field $H_c$ in A/m;

the ferromagnetic losses (in W/kg) at 400 Hz for a sinusoidal induction with a peak value of 2 tesla.

These values were:

after annealing at 725° C.:

| | B (20 $O_e$) | B (50 $O_e$) | B (10 $O_e$) | $H_c$ | Losses |
|---|---|---|---|---|---|
| A | 2.04 | 2.18 | 2.25 | 296 | 131 |
| B | 2.00 | 2.15 | 2.25 | 488 | 158 |
| C | 2.01 | 2.21 | 2.26 | 184 | 94 |

after annealing at 760° C.:

| | B (20 $O_e$) | B (50 $O_e$) | B (10 $O_e$) | $H_c$ | Losses |
|---|---|---|---|---|---|
| A | 2.09 | 2.20 | 2.27 | 216 | 110 |
| B | 2.07 | 2.20 | 2.26 | 232 | 104 |
| C | 2.12 | 2.22 | 2.28 | 152 | 87 |

and after annealing at 850° C.:

| | B (20 $O_e$) | B (50 $O_e$) | B (10 $O_e$) | $H_c$ | Losses |
|---|---|---|---|---|---|
| A | 2.14 | 2.23 | 2.28 | 120 | 86 |
| B | 2.12 | 2.23 | 2.30 | 88 | 74 |
| C | 2.11 | 2.21 | 2.26 | 96 | 75 |

These results show that alloys A and B according to the invention, while still having magnetic properties very similar to alloy C, have markedly improved mechanical properties, since the yield stress may exceed 500 MPa, these properties being comparable to those obtained with alloys according to the prior art containing 0.3% niobium.

What is claimed is:

1. An iron—cobalt alloy comprising iron, impurities resulting from smelting, and, by weight:

$35\% \leqq Co \leqq 55\%$ $0.5\% \leqq V \leqq 2.5\%$ $0.02\% \leqq Ta+2\times Nb \leqq 0.2\%$ $0.0007\% \leqq B \leqq 0.007\%$ $C \leqq 0.05\%$.

2. The iron—cobalt alloy as claimed in claim 1, wherein:

$1.5\% \leqq V \leqq 2.2\%$.

3. The iron—cobalt alloy as claimed in claim 1, wherein:

$0.03\% \leqq Ta+Nb \leqq 0.15\%$.

4. The iron—cobalt alloy as claimed in claim 1, wherein:

$Nb \leqq 0.03\%$.

5. The iron—cobalt alloy as claimed in claim 1, wherein:

$0.001\% \leqq B \leqq 0.003\%$.

6. The iron—cobalt alloy as claimed in claim 1, wherein:

$C \leqq 0.007\%$.

7. The iron—cobalt alloy as claimed in claim 1, wherein the impurities resulting from the smelting operation have contents such that:

$Mn+Si \leqq 0.2\%$ $Cr+Mo+Cu \leqq 0.2\%$ $Ni \leqq 0.2\%$ $S \leqq 0.005\%$.

8. The iron—cobalt alloy as claimed in claim 1, wherein:

$40\% \leqq Co \leqq 50\%$.

9. The iron—cobalt alloy as claimed in claim 2, wherein:

$0.03\% \leqq Ta+Nb \leqq 0.15\%$.

10. The iron—cobalt alloy as claimed in claim 2, wherein:

$Nb \leqq 0.03\%$.

11. The iron—cobalt alloy as claimed in claim 3, wherein:

$Nb \leqq 0.03\%$.

12. The iron—cobalt alloy as claimed in claim 2, wherein:

$0.001\% \leqq B \leqq 0.003\%$.

13. The iron—cobalt alloy as claimed in claim 3, wherein:

$0.001\% \leqq B \leqq 0.003\%$.

14. The iron—cobalt alloy as claimed in claim 4, wherein:

$0.001\% \leqq B \leqq 0.003\%$.

15. The iron—cobalt alloy as claimed in claim 2, wherein:

$C \leqq 0.007\%$.

16. The iron—cobalt alloy as claimed in claim 3, wherein:

$C \leqq 0.007\%$.

17. The iron—cobalt alloy as claimed in claim 4, wherein:

$C \leqq 0.007\%$.

18. The iron—cobalt alloy as claimed in claim 5, wherein:

$C \leqq 0.007\%$.

19. The iron—cobalt alloy as claimed in claim 2, wherein the impurities resulting from the smelting operation have contents such that:

$Mn+Si \leqq 0.2\%$ $Cr+Mo+Cu \leqq 0.2\%$ $Ni \leqq 0.2\%$ $S \leqq 0.005\%$.

20. The iron—cobalt alloy as claimed in claim 3, wherein the impurities resulting from the smelting operation have contents such that:

$Mn+Si \leqq 0.2\%$ $Cr+Mo+Cu \leqq 0.2\%$ $Ni \leqq 0.2\%$ $S \leqq 0.005\%$.

21. The iron—cobalt alloy as claimed in claim 2, wherein:

$40\% \leqq Co \leqq 50\%$.

22. The iron—cobalt alloy as claimed in claim 3, wherein:

$40\% \leqq Co \leqq 50\%$.

23. The iron—cobalt alloy as claimed in claim 1, wherein:

$1.5\% \leqq V \leqq 2.2\%$ $0.03\% \leqq Ta+Nb \leqq 0.15\%$ $Nb \leqq 0.03\%$ $0.001\% \leqq B \leqq 0.003\%$ $C \leqq 0.007\%$ $40\% \leqq Co \leqq 50\%$;

and wherein the impurities resulting from smelting have contents such that:

$Mn+Si \leqq 0.2\%$ $Cr+Mo+Cu \leqq 0.2\%$ $Ni \leqq 0.2\%$ $S \leqq 0.005\%$.

* * * * *